US012729921B2

(12) United States Patent
Vining et al.

(10) Patent No.: US 12,729,921 B2
(45) Date of Patent: Sep. 8, 2026

(54) CHARGING HANDLE FOR A FIREARM

(71) Applicants: Ryan Vining, Patterson, LA (US); Austin Menard, Broussard, LA (US); Brandon Elias, Lafayette, LA (US)

(72) Inventors: Ryan Vining, Patterson, LA (US); Austin Menard, Broussard, LA (US); Brandon Elias, Lafayette, LA (US)

(73) Assignee: JA IP Holding, LLC, Morgan City, LA (US)

( * ) Notice: Subject to any disclaimer, the term of this patent is extended or adjusted under 35 U.S.C. 154(b) by 0 days.

(21) Appl. No.: 19/320,459

(22) Filed: Sep. 5, 2025

(65) Prior Publication Data

US 2026/0002745 A1 Jan. 1, 2026

Related U.S. Application Data

(63) Continuation-in-part of application No. 18/988,837, filed on Dec. 19, 2024, now Pat. No. 12,492,874.

(60) Provisional application No. 63/612,636, filed on Dec. 20, 2023.

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 35/06
See application file for complete search history.

(56) References Cited

U.S. PATENT DOCUMENTS

| | | | | |
|---|---|---|---|---|
| 6,311,603 | B1 * | 11/2001 | Dunlap | F41A 3/72 42/2 |
| 9,500,421 | B1 * | 11/2016 | Geissele | F41A 3/72 |
| 11,885,581 | B2 * | 1/2024 | Torgersen | F41A 35/06 |
| 2013/0092014 | A1 * | 4/2013 | Kincel | F41A 3/72 89/1.4 |
| 2016/0153731 | A1 * | 6/2016 | Sugg | F41A 35/06 89/1.4 |
| 2016/0356564 | A1 * | 12/2016 | Curry | F41A 3/72 |
| 2017/0299294 | A1 * | 10/2017 | Underwood | F41A 3/72 |
| 2021/0172692 | A1 * | 6/2021 | Frazier | F41A 35/06 |
| 2021/0222972 | A1 * | 7/2021 | Bray | F41A 35/06 |
| 2024/0060738 | A1 * | 2/2024 | Michaud | F41A 3/72 |

* cited by examiner

*Primary Examiner* — Joshua E Freeman
(74) *Attorney, Agent, or Firm* — Asgaard Patent Services, LLC; F. Wayne Thompson, Jr.

(57) ABSTRACT

The charging handle for a firearm includes a gas blowback mitigation feature. This gas blowback mitigation feature is configured to reduce the volume of combustion gases exiting beneath the charging handle when firing the host firearm, particularly when a sound suppressor is attached.

18 Claims, 21 Drawing Sheets

CHARGING HANDLE FOR A FIREARM

CROSS-REFERENCE TO RELATED APPLICATION(S)

This application is a continuation-in-part of U.S. patent application Ser. No. 18/988,837, filed on Dec. 19, 2024, which claims the benefit of U.S. Provisional Application Ser. No. 63/612,636, filed on Dec. 20, 2023. The entire disclosure of each of the above-referenced applications is incorporated herein by reference.

TECHNICAL FIELD

This disclosure relates to implementations of a charging handle for a firearm. More particularly, it concerns an improved charging handle for Stoner-type firearms, including AR-10 type, AR-15 type, and M4 type firearms, as well as their clones and derivatives.

BACKGROUND

The charging handle of a firearm, such as an AR-15 type rifle, enables the user to manually manipulate the bolt carrier group. Its primary functions include chambering a round from the magazine, clearing the chamber, and resetting the hammer. Additionally, the charging handle can assist in resolving malfunctions by allowing manual cycling of the bolt carrier group.

Accordingly, there is a need for the charging handle disclosed herein. The present invention is directed to providing a charging handle configured to address these and other needs.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Implementations of a charging handle for a firearm, such as an AR-15 type rifle, are disclosed. The charging handle includes a gas blowback mitigation feature configured to reduce the volume of combustion gases exiting beneath the charging handle when firing the host firearm, particularly when a sound suppressor is attached.

An example charging handle comprises: a body, a central shaft extending forwardly from the body, and a cutout formed in an underside of the central shaft. The central shaft is configured to engage a bolt carrier group of the firearm, and the cutout defines a cavity bounded by a rear sidewall, two lateral sidewalls, and a bottom.

Another example charging handle comprises: a body, a central shaft extending forwardly from the body, and a cutout formed in an underside of the central shaft. The central shaft is configured to engage a bolt carrier group of the firearm. The cutout defines a cavity bounded by a rear sidewall, a first lateral sidewall, a second lateral sidewall, and a bottom. The cavity has a generally prismatic shape.

It should be appreciated that any feature described herein can be claimed in combination with any other feature(s) described herein, regardless of whether the features originate from the same described implementation.

The details of one or more aspects of the disclosure are set forth in the accompanying drawings and the description below. Other features, objects, and advantages of the techniques described in this disclosure will be apparent from the description and drawings, and from the claims.

Numerous additional features and advantages of the present disclosure will become apparent to those skilled in the art upon consideration of the implementation descriptions provided below.

Additional features and advantages are described herein and will be apparent from the following description and figures.

BRIEF DESCRIPTION OF THE DRAWINGS

Like reference numerals refer to corresponding parts throughout the several views of the drawings.

DETAILED DESCRIPTION

FIGS. 1-11 illustrate an example charging handle 100 according to the principles of the present disclosure. The charging handle 100 is configured for use with an AR-15 type firearm. However, with minor modifications, some of its features could be adapted for use with other firearms.

Figure 3:
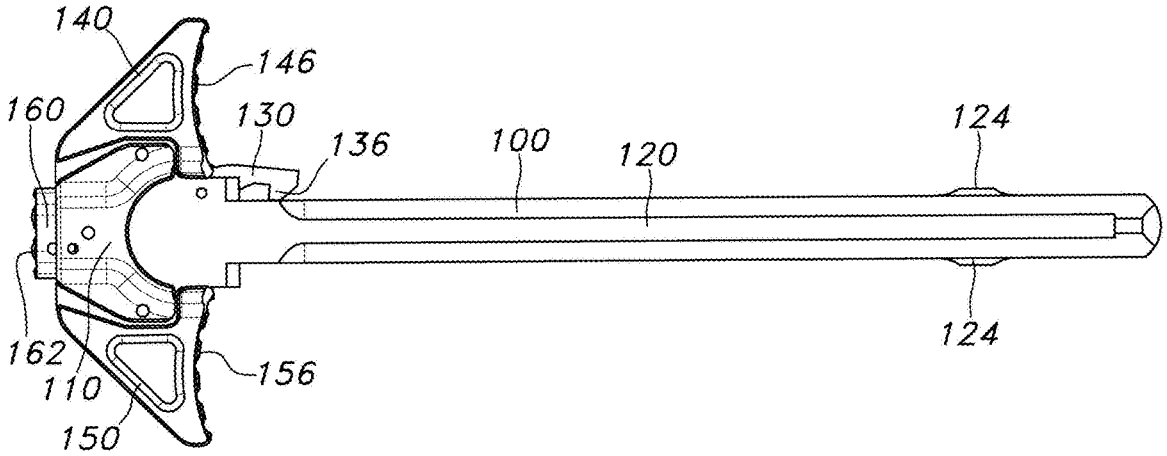
FIG. 3 is a top plan view of the charging handle shown in FIG. 1.
Figure 4:
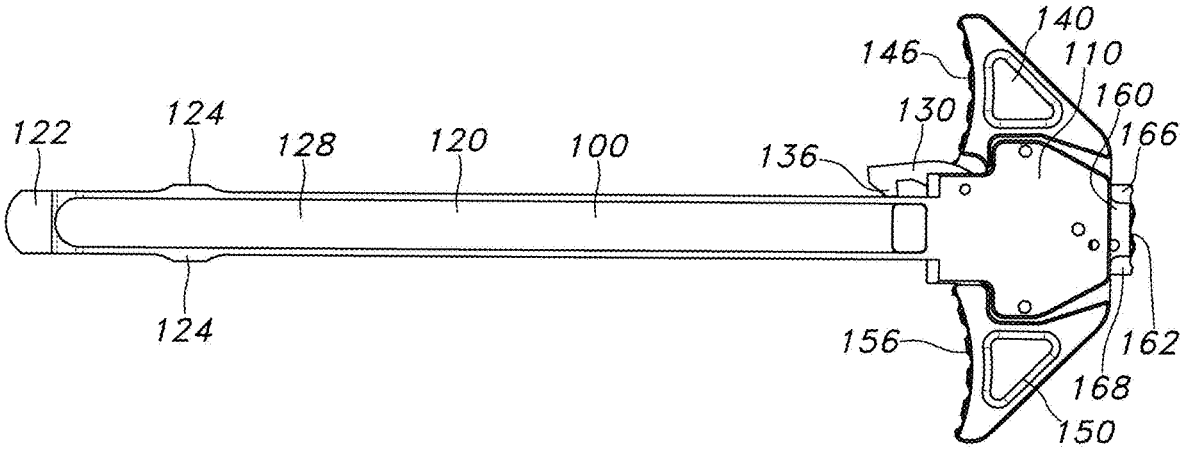
FIG. 4 is a bottom plan view of the charging handle shown in FIG. 1.
Figure 5:
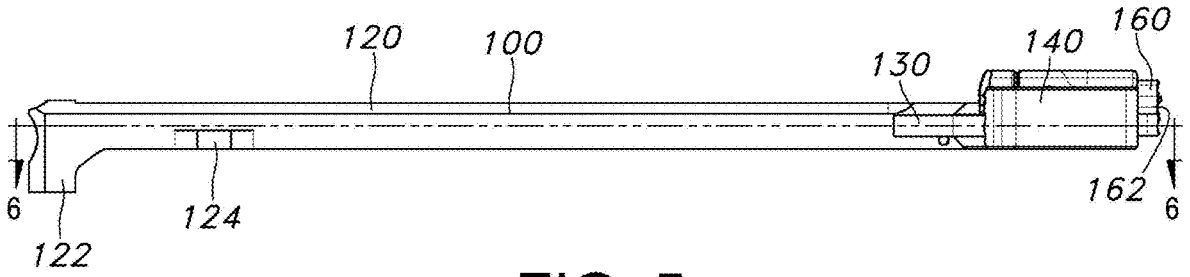
FIG. 5 is a side elevational view of the charging handle shown in FIG. 1.

The charging handle 100 comprises a body 110, a central shaft 120, and a latch assembly that includes a latch 130, a first lever 140, a second lever 150, and a plunger 160. The body 110 is disposed behind the central shaft 120, which extends forward from the body 110. The two levers (140, 150) and the latch 130 are pivotally coupled to the body 110; the plunger 160 is slidably disposed within a recess 114 in the back end of the body 110. When in a resting position, where the plunger 160 is not depressed, the plunger 160 is configured to prevent rotation of the levers 140, 150 (see, e.g., FIG. 6). When the plunger 160 is in a depressed position, the latch assembly is configured to allow either or both levers (140, 150) to be pulled, transitioning the latch 130 from a relaxed position (as shown in FIG. 3), where the latch 130 can engage the receiver of a firearm, to a released position (see, e.g., FIG. 10), which permits the normal operation of the charging handle 100.

Figure 12:
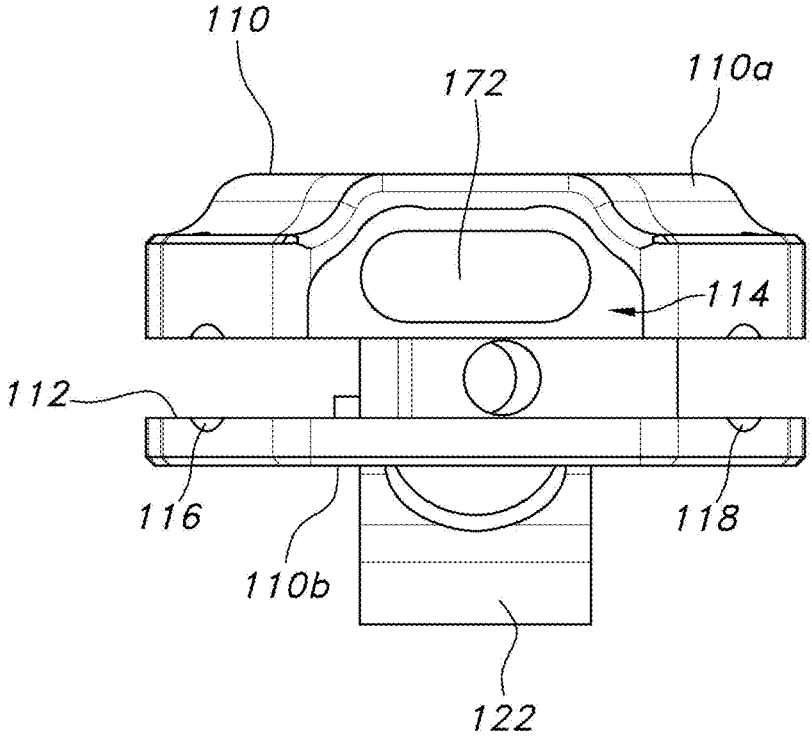
FIG. 12 is a rear elevational view of the charging handle body.
Figure 13:
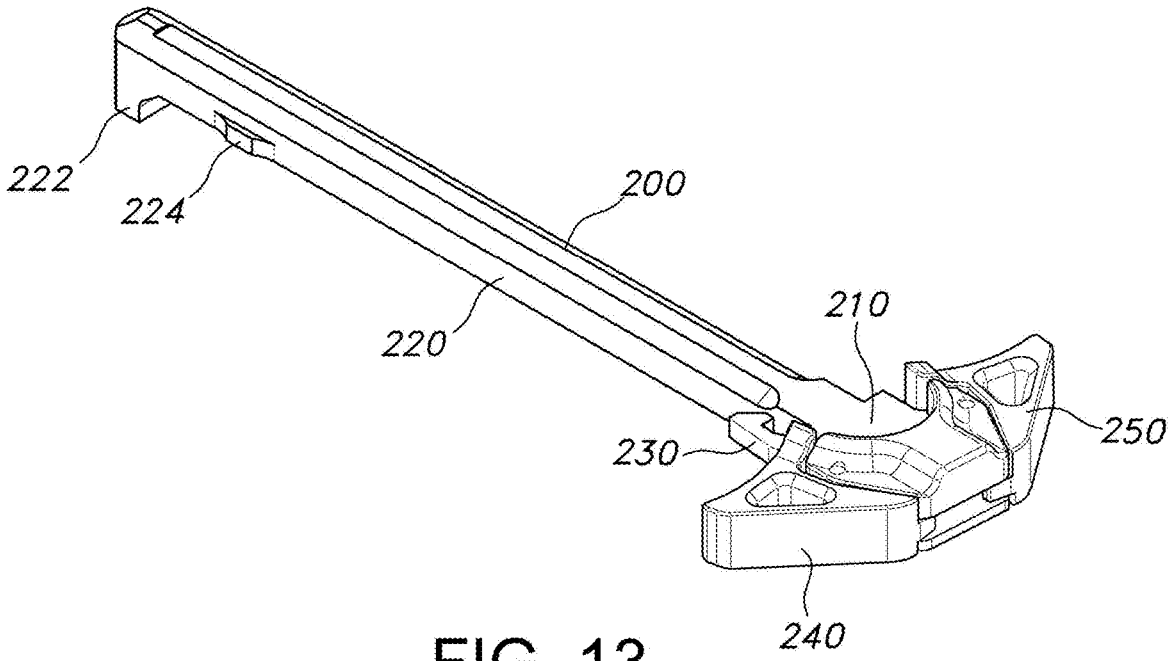
FIG. 13 is a perspective view of another charging handle according to the principles of the present disclosure.
Figure 14:
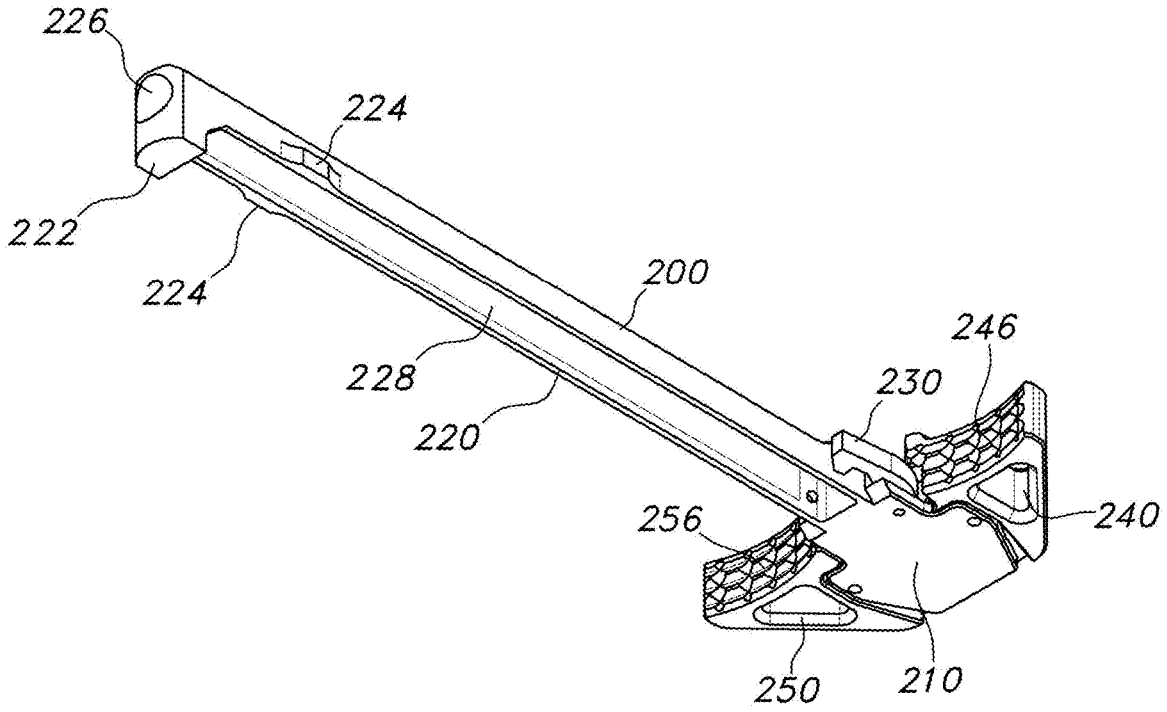
FIG. 14 is another perspective view of the charging handle shown in FIG. 13.

The body 110 of the charging handle 100 includes a receiving area 112, the recess 114 for the plunger 160, and a plurality of apertures for fasteners (e.g., roll pins) used to connect the latch 130, levers (140, 150), and plunger 160 to the body 110. The body 110 has an upper portion 110*a* and a lower portion 110*b*, which is spaced apart from and located below the upper portion 110*a* (see, e.g., FIG. 12). The upper portion 110*a* and the lower portion 110*b* define therebetween the receiving area 112, the purpose of which will be described in greater detail below. The recess 114 for the plunger 160 is disposed in the upper portion 110*a* of the body 110.

The central shaft 120 of the charging handle 100 includes a bolt carrier group engaging portion 122, a pair of alignment tabs 124, an aperture 126, and a longitudinal groove 128.

The bolt carrier group engaging portion 122 of the central shaft 120 is disposed toward a front end of the charging handle 100. The bolt carrier group engaging portion 122 engages the bolt carrier group of a firearm, such as an AR-15 type rifle, by interfacing with the charging handle engaging portion on the bolt carrier. The charging handle engaging portion is a projection on the bolt carrier, the bolt carrier being configured to carry a bolt of the bolt carrier group.

The pair of alignment tabs 124 are disposed on opposite sides of the central shaft 120 and assist in aligning the central shaft 120 in a particular direction within a slot in the upper receiver of a firearm, such as an AR-15 type rifle. Each alignment tab 124 is a projection extending from a side surface of the central shaft 120 that fits within a corresponding longitudinal recess in the upper receiver for slidable forward and backward movement of the charging handle 100 relative to the upper receiver.

The aperture 126 of the central shaft 120 is disposed within the bolt carrier group engaging portion 122 and is configured to receive the gas key of the bolt carrier therethrough. The aperture 126 provides clearance for the gas key, ensuring the charging handle 100 can properly engage with the bolt carrier.

The longitudinal groove 128 of the central shaft 120 extends from the aperture 126 to the body 110 of the charging handle 100, and is an otherwise well-known feature of charging handles configured for use with an AR-15 type firearm.

The latch 130 is pivotally coupled to the body 110 of the charging handle 100 by a pin, or other suitable fastener. The latch 130 includes a latch arm 132, a hook arm 134, and a hook 136. The latch arm 132 is an elongate shaft that has a cam surface 138 on one side. The hook arm 134 includes an aperture 135 configured to receive the pin about which the latch 130 pivots. The hook 136 projects laterally from the hook arm 134 and is configured to engage a latch depression on the side of the upper receiver of an AR-15 type firearm. When the hook 136 engages the latch depression, the charging handle 100 is prevented from moving rearward and is effectively locked in position relative to the upper receiver. The latch arm 132 is disposed within the receiving area 112 of the body 110 of the charging handle 100, and is held there by the pin extending through the aperture 135 in the hook arm 134 of the latch 130.

The first lever 140 and the second lever 150 of the charging handle 100 are pivotally coupled to opposite sides of the body 110. Each lever (140, 150) has an aperture (142, 152) configured to receive a pin about which the lever (140, 150) pivots; the pin passes through apertures in the body 110 and the aperture (142, 152) in the lever (140, 150) to secure the lever to the body 110 of the charging handle 100. Respective bias elements (e.g., compression springs) bias the first lever 140 and the second lever 150 toward their relaxed positions (see, e.g., FIG. 3). The first bias element 144 is positioned within a receptacle 116 in the body 110 angled so that an end of the first biasing element 144 acts on the first lever 140; the second bias element 154 is positioned within a receptacle 118 in the body 110 angled so that an end of the second biasing element 154 acts on the second lever 150.

The first lever 140 and the second lever 150 each include an arcuate front surface (146, 156) that, in some implementations, is textured to provide a positive tactile gripping surface when the charging handle 100 is actuated by the user. The arcuate front surfaces (146, 156) allow the user to engage the first lever 140 and/or the second lever 150 with one or more fingers. Example textures that may be applied to the front surfaces (146, 156) of the levers (140, 150) include, but are not limited to, a plurality of ribs, grooves, bumps or tactile serrations. As discussed in greater detail below, when the plunger 160 is depressed, applying at least a predetermined threshold force rearward (e.g., with one or more fingers) to the first lever 140, the second lever 150, or both the first lever 140 and the second lever 150, releases the latch 130 from the latch depression in the upper receiver, allowing the charging handle 100 to be pulled rearward.

Both the first lever 140 and the second lever 150 also include a stop arm (145, 155) and a biasing arm (148, 158). Each stop arm (145, 155) is a shaft with an end (145*a*, 155*a*) configured to interface with the plunger 160 of the charging handle 100. Each biasing arm (148, 158) is an elongate shaft with a radiused tip (148*a*, 158*a*). As shown in FIG. 11A, the end portions (148*a*, 158*a*) of the biasing arms (148, 158) nest together, allowing the radiused tips of both biasing arms (148, 158) to simultaneously contact the cam surface 138 of the latch 130. In this context, "nest" refers to an overlapping arrangement of the end portions (148*a*, 158*a*) of the biasing arms (148, 158) (see, e.g., FIG. 11A).

The plunger 160 includes an actuator portion 162, a slot 164 that extends through the plunger 160, a pair of opposing cutouts (166, 168), and a guide boss 170. The actuator portion 162 is textured to provide a tactile contact surface. The plunger 160 is slidably retained within the recess 114 of the body 110 by a pin extending through both the body 110 and the slot 164 in the plunger 160. The first cutout 166 and the second cutout 168 are disposed on opposite sides of the plunger 160. Each cutout (166, 168) is configured to receive the end (145*a*, 155*a*) of the adjacent stop arm (145, 155) when the plunger is in the depressed position, and includes a radiused surface. The guide boss 170 is slidably received within a guide groove 172 located in the recess 114 of the body 110 and includes two cylindrical receptacles (174, 176). A biasing element, such as a compression spring, is positioned within each cylindrical receptacle (174, 176). The two biasing elements together generate a restoring force that urges the plunger 160 away from the guide groove 172 in the recess 114, causing the actuator portion 162 of the plunger 160 to extend outward from the recess 114 of the charging handle 100.

Operation and Use

Figure 1:
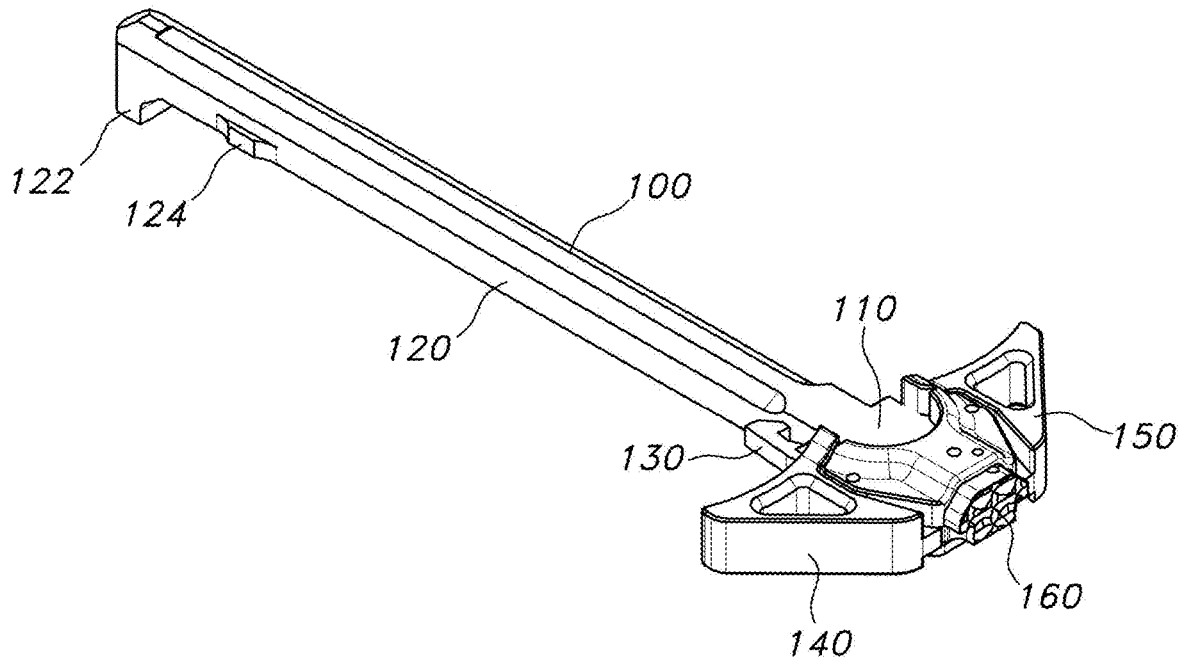
FIG. 1 is a perspective view of a charging handle according to the principles of the present disclosure.
Figure 2:
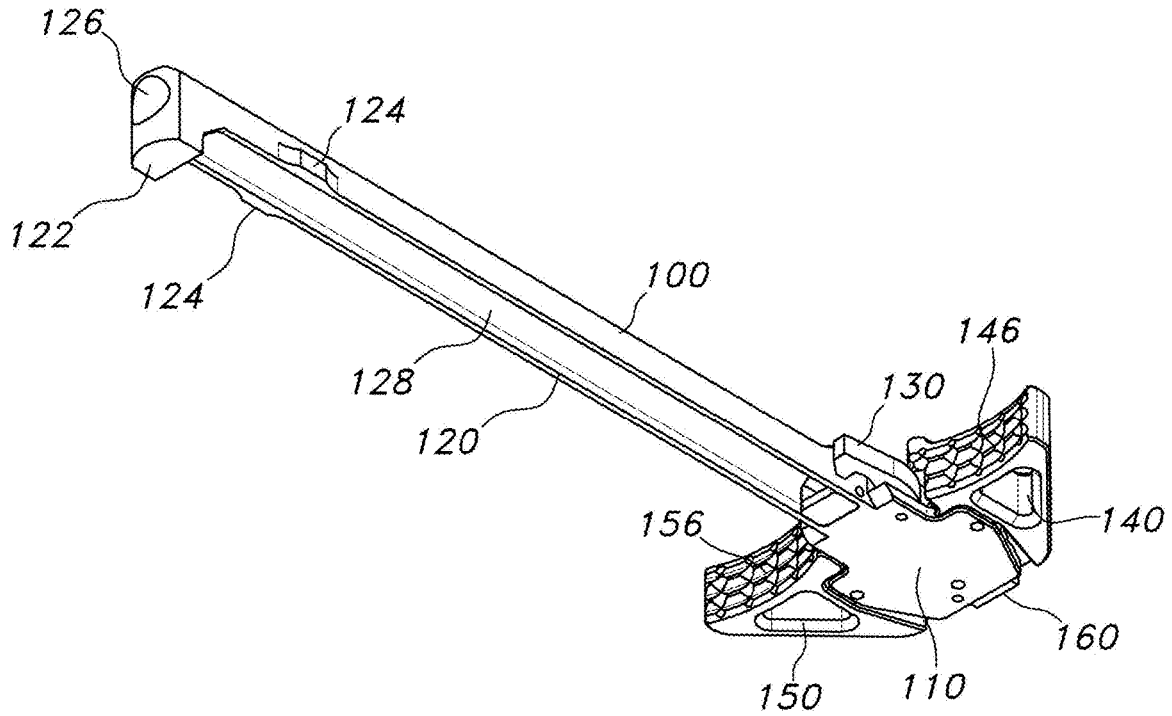
FIG. 2 is another perspective view of the charging handle shown in FIG. 1.
Figure 6:
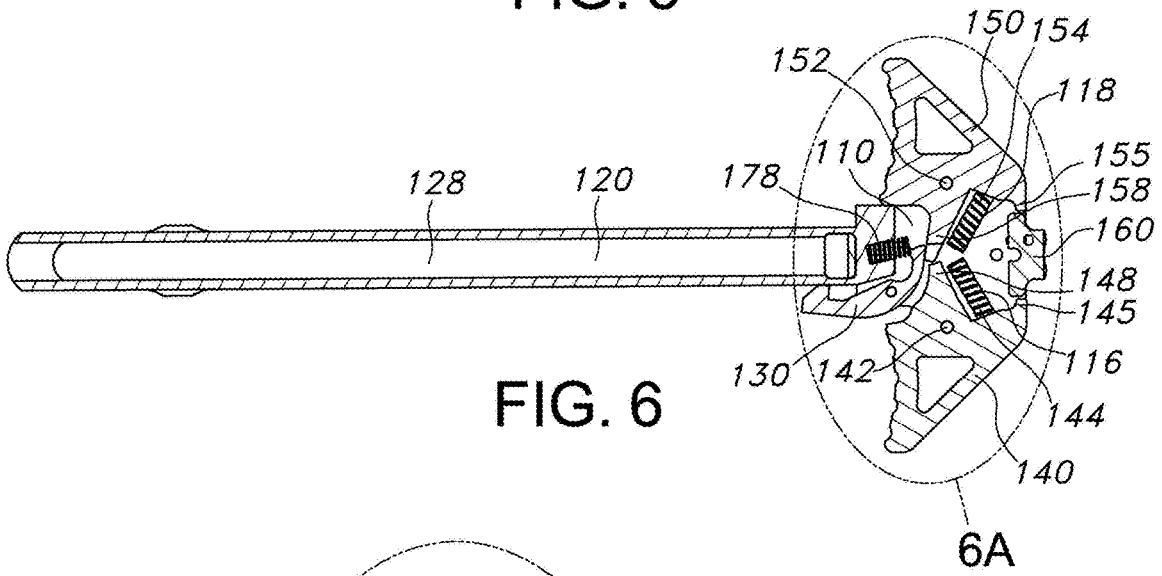
FIG. 6 is a cross-sectional view of the charging handle, taken along line 6-6 shown in FIG. 5.
Figure 6A:
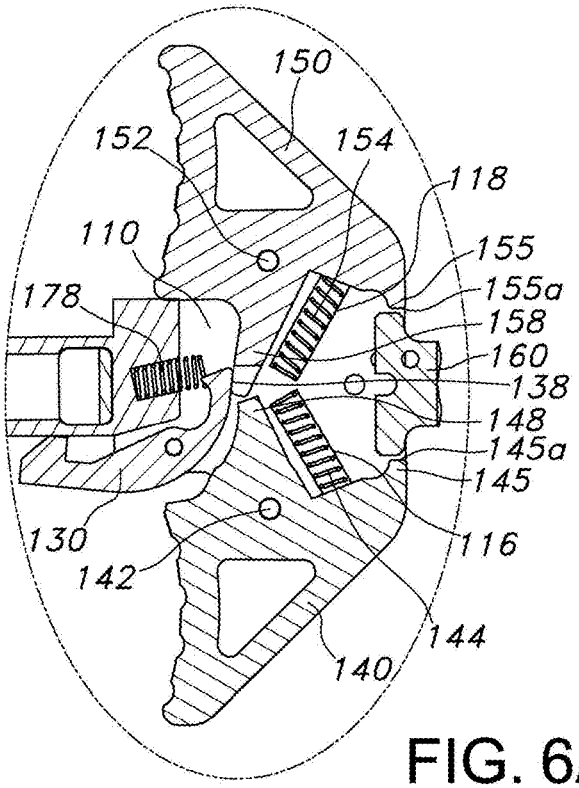
FIG. 6A is an enlarged view of a portion of the charging handle shown in FIG. 6.
Figure 7:
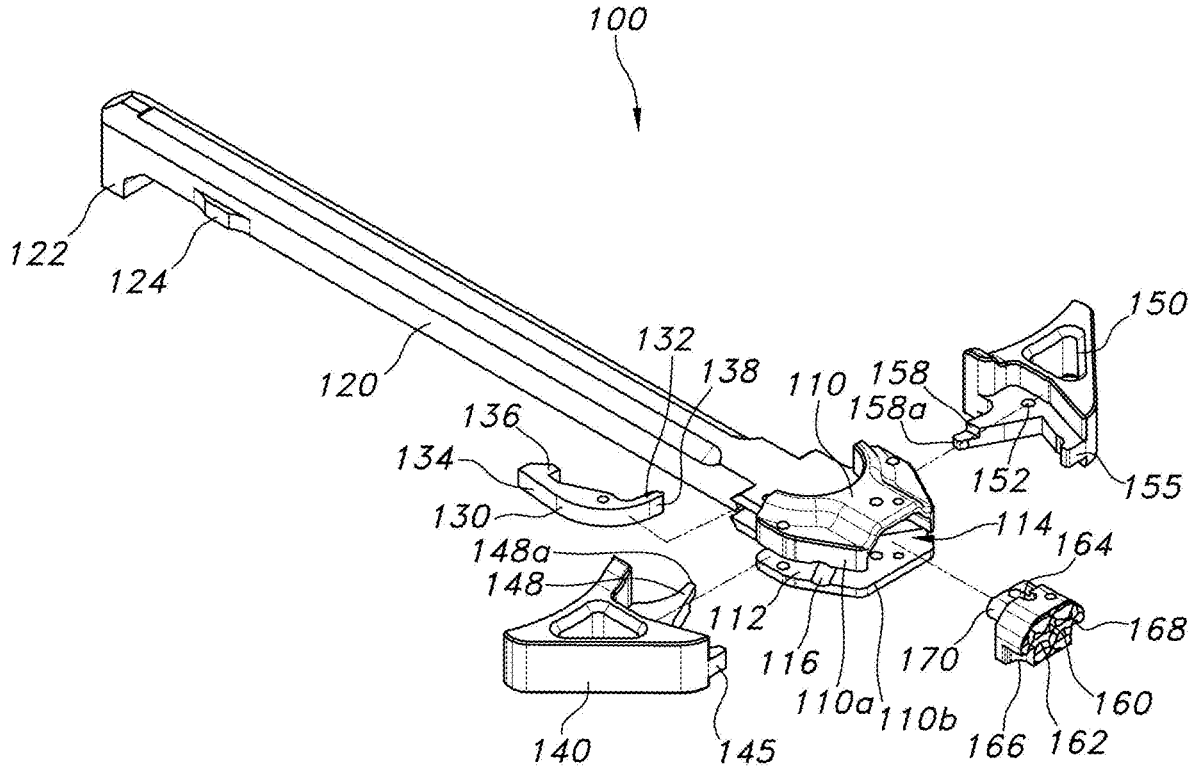
FIG. 7 is an exploded perspective view of the charging handle shown in FIG. 1.
Figure 8:
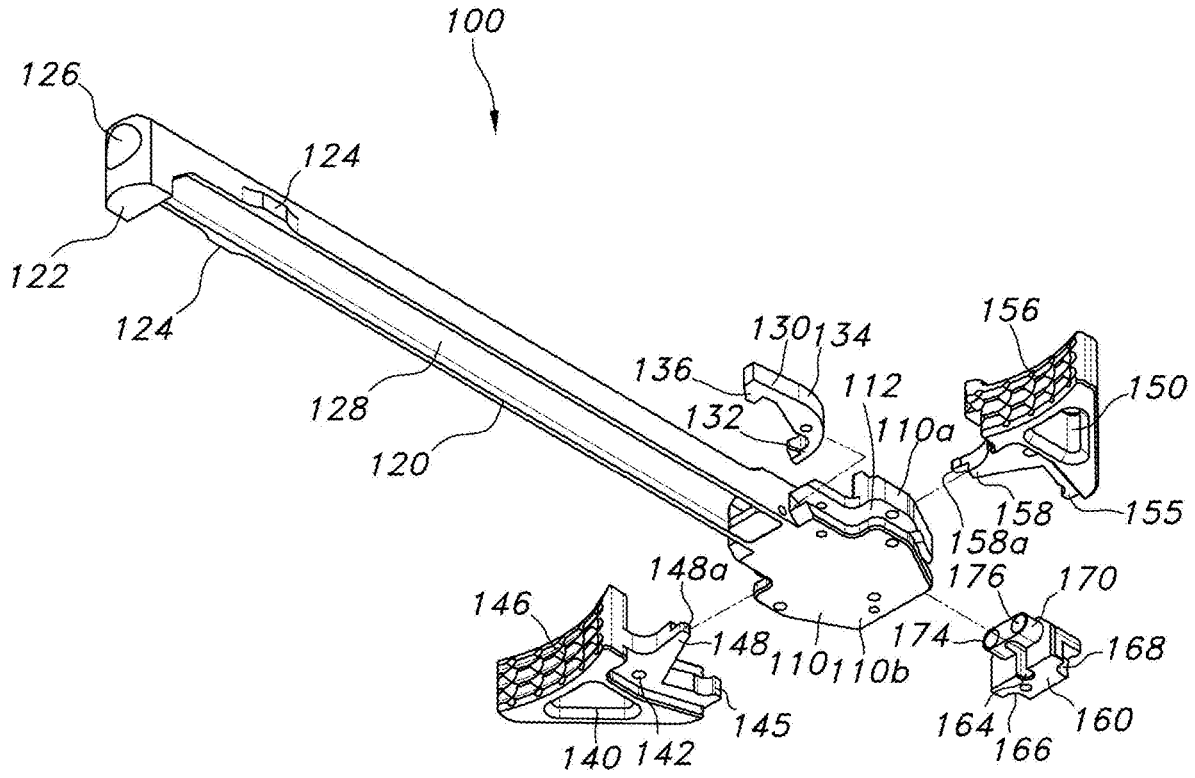
FIG. 8 is another exploded perspective view of the charging handle shown in FIG. 1.
Figure 9:
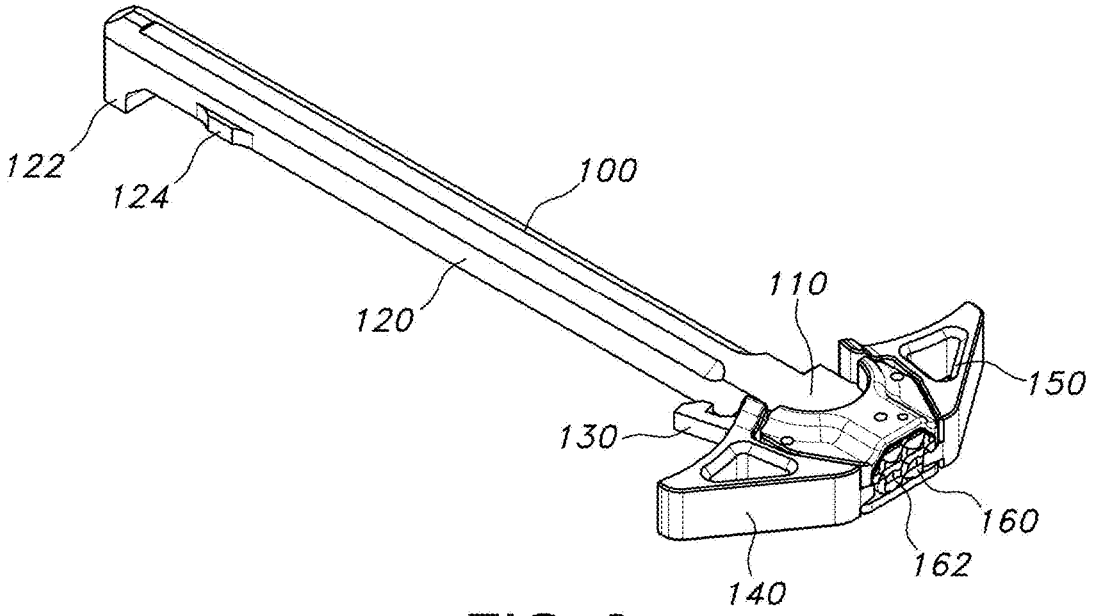
FIG. 9 is yet another perspective view of the charging handle shown in FIG. 1.

When the charging handle 100 is assembled, the biasing arm 148 of the first lever 140 and the biasing arm 158 of the second lever 150 are positioned within the receiving area 112 of the body 110. The first lever 140 and the second lever 150 are configured such that both biasing arms (148, 158) are in contact with the cam surface 138 on the latch arm 132. While the plunger 160 is in the resting position (as shown in FIG. 1), pulling either lever (140 or 150) causes its respective stop arm (145 or 155) to contact a side surface of the plunger 160, thereby preventing rotation of the pulled lever (s) (see, e.g., FIG. 6A).

Figure 10:
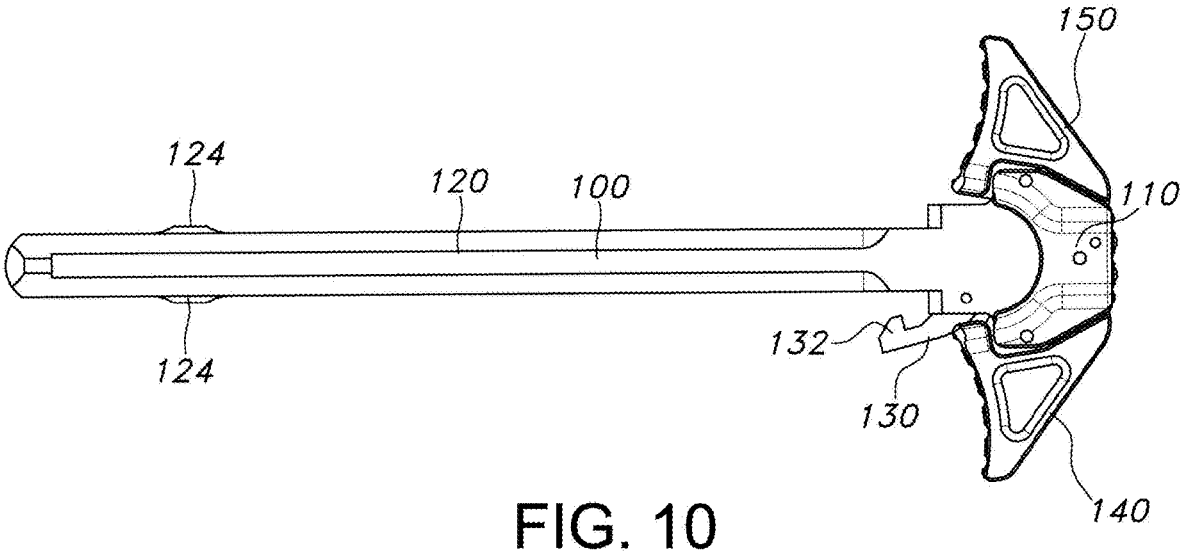
FIG. 10 is another top plan view of the charging handle shown in FIG. 1.
Figure 11:
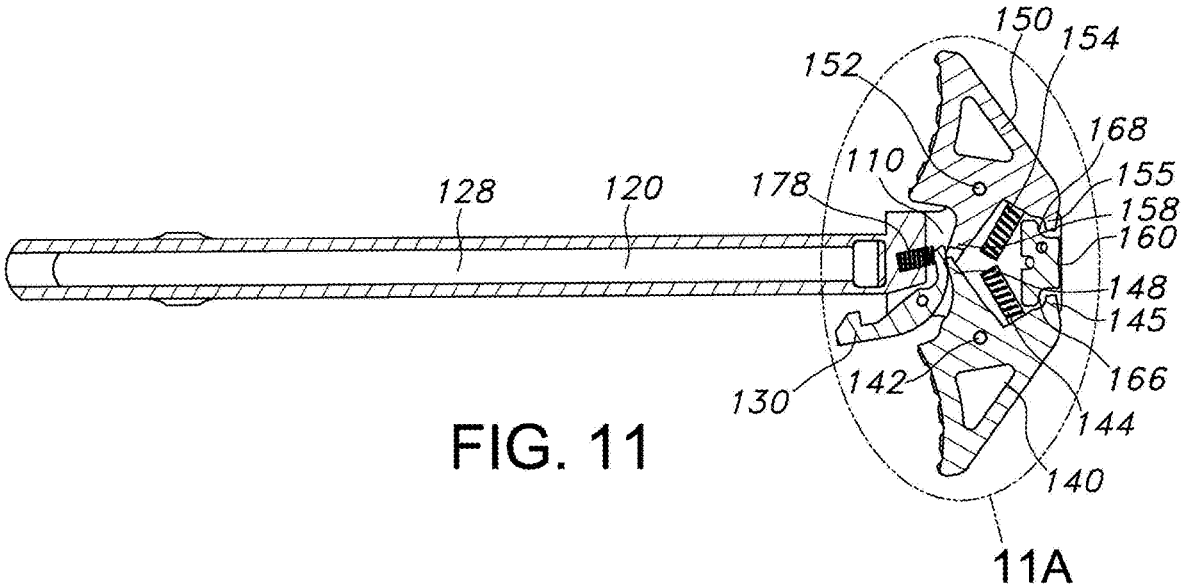
FIG. 11 is a cross-sectional view of the charging handle, taken along line 11-11 shown in FIG. 10.
Figure 11A:
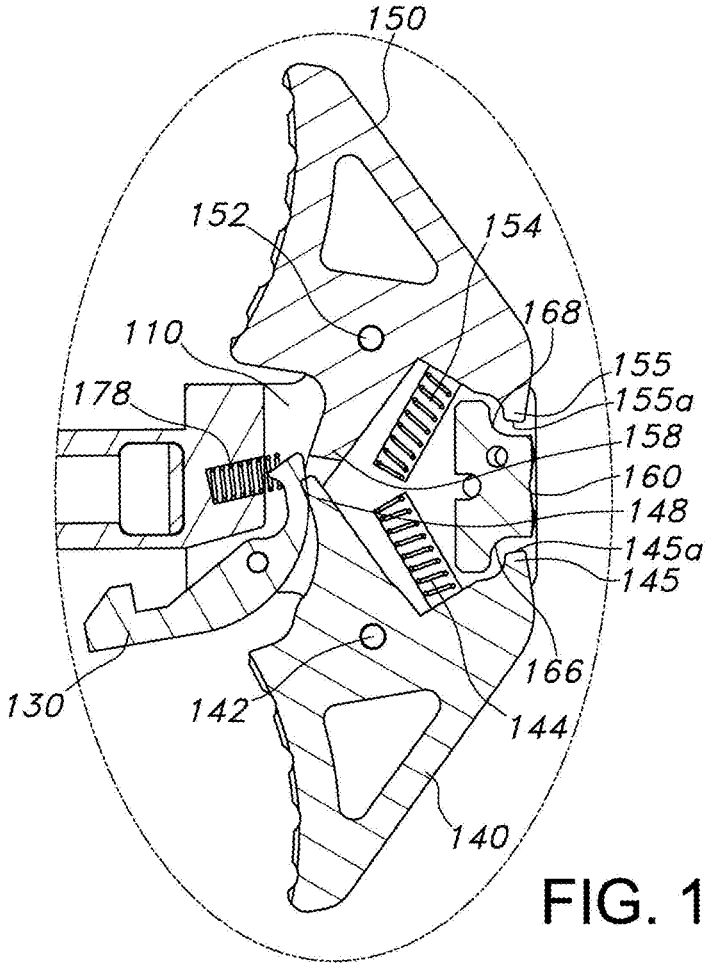
FIG. 11A is an enlarged view of a portion of the charging handle shown in FIG. 11.

When the plunger 160 is in the depressed position, applying a sufficient rearward force to the first lever 140, the second lever 150, or both causes the respective biasing arm(s) (148, 158) to press against the latch arm 132, thereby urging the latch 130 into the released position (see, e.g., FIGS. 10 and 11). At the same time, the end (145*a*, 155*a*) of the stop arm (145, 155) on the pulled lever(s) rotates into the adjacent cutout (166, 168) in the side surface of the plunger 160, allowing the lever(s) to rotate (see, e.g., FIG. 11A).

When the latch 130 is biased into the released position, the latch biasing mechanism, a compression spring 178 housed within a cavity in the body 110, is compressed. This compression generates a restoring force that urges the latch 130 to return to its relaxed position once the force applied by the user to the first lever 140 and/or the second lever 150 is sufficiently reduced.

Although not shown, in some implementations, the latch assembly of the charging handle 100 may omit the second lever 150 without departing from the scope of the present disclosure.

FIGS. 13-23 illustrate another example charging handle 200 according to the principles of the present disclosure. The charging handle 200 is similar to the charging handle 100 disclosed above. However, the charging handle 200 omits the plunger 160 and includes a clearance pocket 260 within the receiving area 212 to provide clearance for the nested end portions (248*a*, 258*a*) of the biasing arms (248, 258) of the levers (240, 250).

Figure 15:
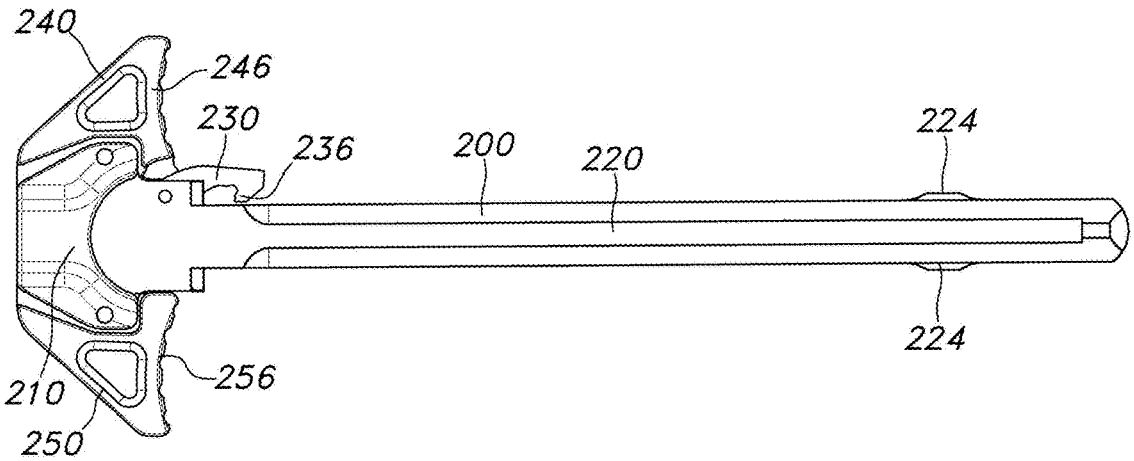
FIG. 15 is a top plan view of the charging handle shown in FIG. 13.
Figure 16:
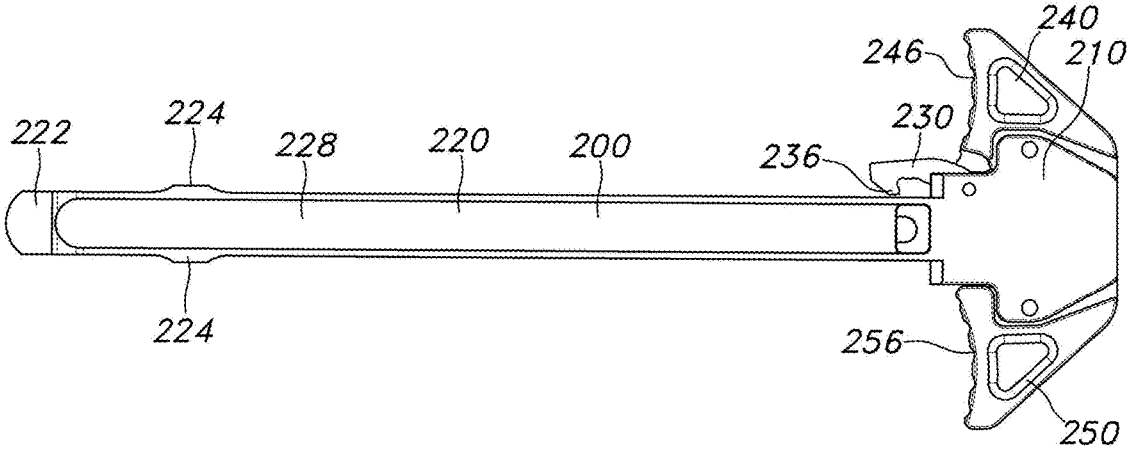
FIG. 16 is a bottom plan view of the charging handle shown in FIG. 13.
Figure 17:
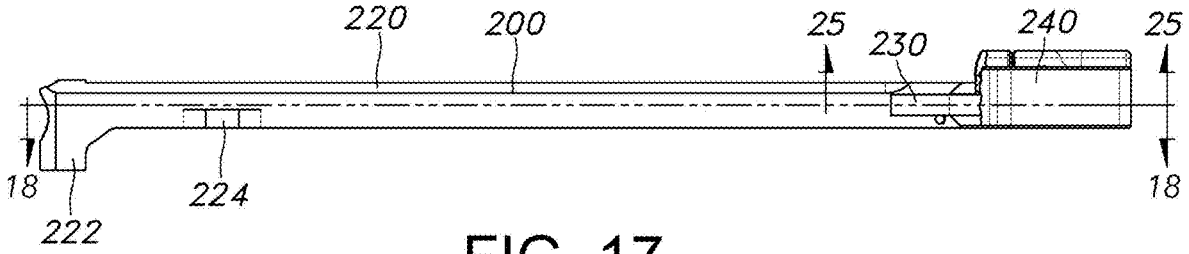
FIG. 17 is a side elevational view of the charging handle shown in FIG. 13.

The charging handle 200 comprises a body 210, a central shaft 220, and a latch assembly that includes a latch 230, a first lever 240, and a second lever 250. The body 210 is disposed behind the central shaft 220, which extends forward from the body 210. The two levers (240, 250) and the latch 230 are pivotally coupled to the body 210. The latch assembly is configured to allow either or both levers (240, 250) to be pulled, transitioning the latch 230 from a relaxed position (as shown in FIG. 15), where the latch 230 can engage the receiver of a firearm, to a released position (see, e.g., FIG. 22), which permits the normal operation of the charging handle 200.

Figure 24:
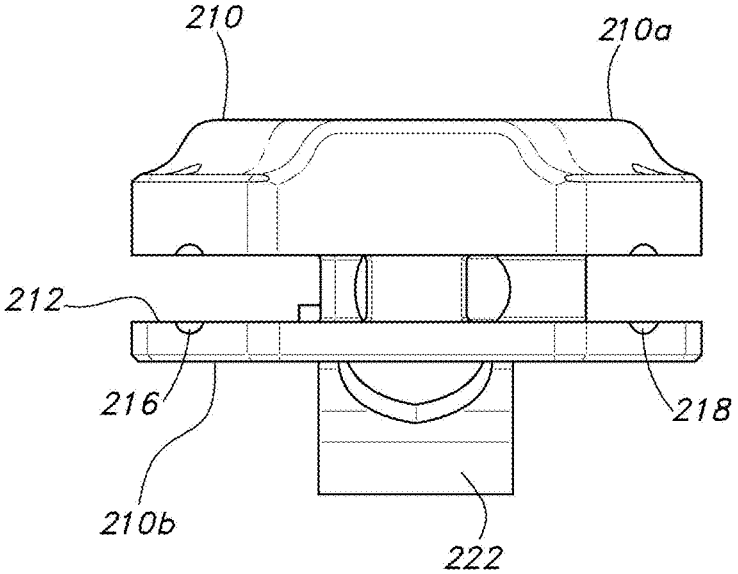
FIG. 24 is a rear elevational view of the charging handle body.
Figure 25:
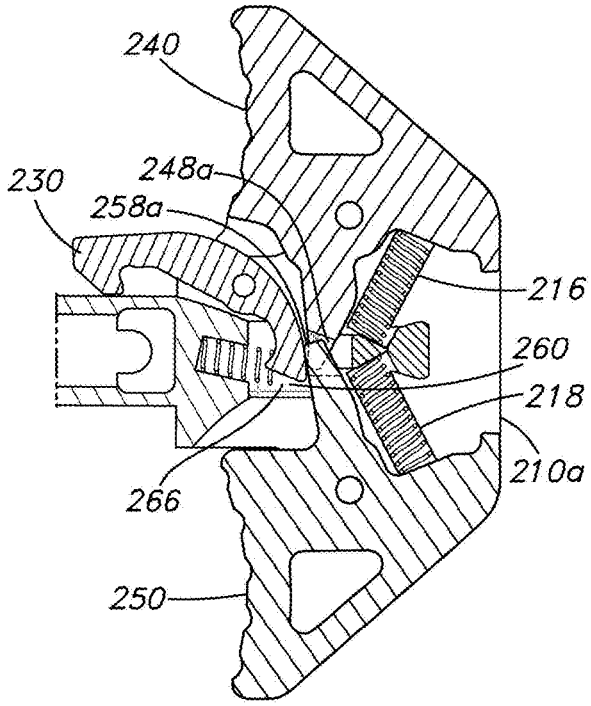
FIG. 25 is a cross-sectional view of the charging handle, taken along line 25-25 shown in FIG. 17.

The body 210 of the charging handle 200 includes a receiving area 212, and a plurality of apertures for fasteners (e.g., roll pins) used to connect the latch 230 and levers (240, 250) to the body 210. The body 210 comprises an upper portion 210*a* and a lower portion 210*b*, which is spaced apart from and located below the upper portion 210*a* (see, e.g., FIG. 24). The upper portion 210*a* and the lower portion 210*b* define therebetween the receiving area 212, the purpose of which will be described in greater detail below.

The central shaft 220 of the charging handle 200 includes a bolt carrier group engaging portion 222, a pair of alignment tabs 224, an aperture 226, and a longitudinal groove 228.

The bolt carrier group engaging portion 222 of the central shaft 220 is disposed toward a front end of the charging handle 200. The bolt carrier group engaging portion 222 engages the bolt carrier group of a firearm, such as an AR-15 type rifle, by interfacing with the charging handle engaging portion on the bolt carrier. The charging handle engaging portion is a projection on the bolt carrier, the bolt carrier being configured to carry a bolt of the bolt carrier group.

The pair of alignment tabs 224 are disposed on opposite sides of the central shaft 220 and assist in aligning the central shaft 220 in a particular direction within a slot in the upper receiver of a firearm, such as an AR-15 type rifle. Each alignment tab 224 is a projection extending from a side surface of the central shaft 220 that fits within a corresponding longitudinal recess in the upper receiver for slidable forward and backward movement of the charging handle 200 relative to the upper receiver.

The aperture 226 of the central shaft 220 is disposed within the bolt carrier group engaging portion 222 and is configured to receive the gas key of the bolt carrier therethrough. The aperture 226 provides clearance for the gas key, ensuring the charging handle 200 can properly engage with the bolt carrier.

The longitudinal groove 228 of the central shaft 220 extends from the aperture 226 to the body 210 of the charging handle 200, and is an otherwise well-known feature of charging handles configured for use with an AR-15 type firearm.

The latch 230 is pivotally coupled to the body 210 of the charging handle 200 by a pin, or other suitable fastener. The latch 230 includes a latch arm 232, a hook arm 234, and a hook 236. The latch arm 232 is an elongate shaft that has a cam surface 238 on one side. The hook arm 234 includes an aperture 235 configured to receive the pin about which the latch 230 pivots. The hook 236 projects laterally from the hook arm 234 and is configured to engage a latch depression on the side of the upper receiver of an AR-15 type firearm. When the hook 236 engages the latch depression, the charging handle 200 is prevented from moving rearward and is effectively locked in position relative to the upper receiver. The latch arm 232 is disposed within the receiving area 212 of the body 210 of the charging handle 200, and is held there by the pin extending through the aperture 235 in the hook arm 234 of the latch 230.

The first lever 240 and the second lever 250 of the charging handle 200 are pivotally coupled to opposite sides of the body 210. Each lever (240, 250) has an aperture (242, 252) configured to receive a pin about which the lever (240, 250) pivots. The pin extends through apertures in the body 210 and the aperture (242, 252) of the lever (240, 250), thereby securing the lever to the body 210 of the charging handle 200. Respective bias elements (e.g., compression springs) bias the first lever 240 and the second lever 250 toward their relaxed positions (see, e.g., FIG. 15). The first bias element 244 is positioned within a receptacle 216 in the body 210 angled so that an end of the first biasing element 244 acts on the first lever 240; the second bias element 254 is positioned within a receptacle 218 in the body 210 angled so that an end of the second biasing element 254 acts on the second lever 250.

The first lever 240 and the second lever 250 each include an arcuate front surface (246, 256) that, in some implementations, is textured to provide a positive tactile gripping surface when the charging handle 200 is actuated by the user. The arcuate front surfaces (246, 256) allow the user to engage the first lever 240 and/or the second lever 250 with one or more fingers. Example textures that may be applied to the front surfaces (246, 256) of the levers (240, 250) include, but are not limited to, a plurality of ribs, grooves, bumps or tactile serrations. Applying at least a predetermined threshold force rearward (e.g., with one or more fingers) to the first lever 240, the second lever 250, or both the first lever 240 and the second lever 250, releases the latch 230 from the latch depression in the upper receiver, thereby allowing the charging handle 200 to be pulled rearward.

Figure 23:
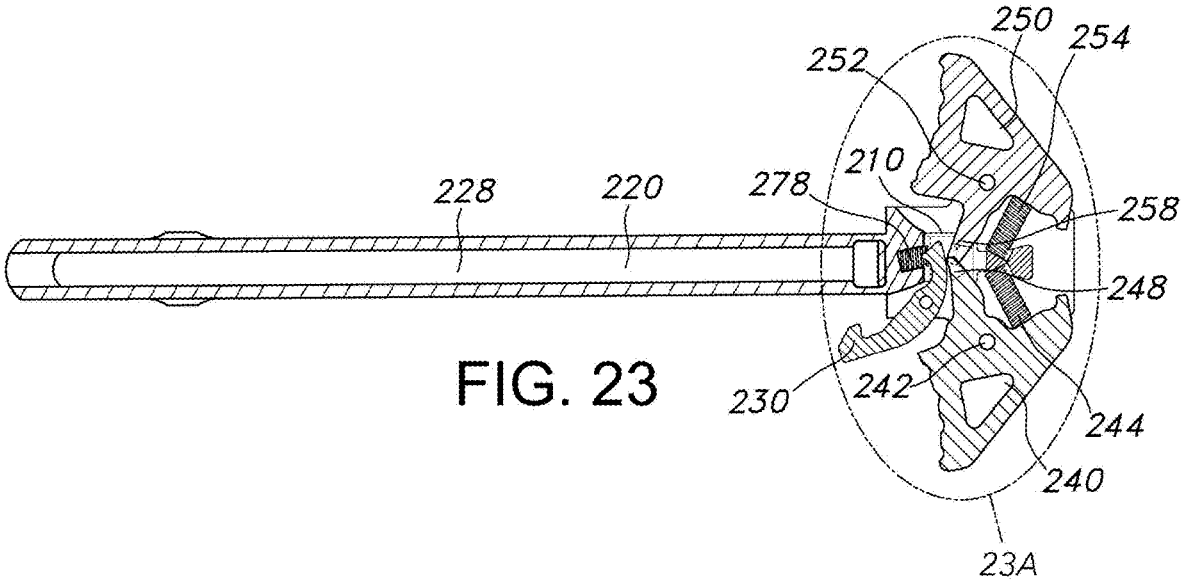
FIG. 23 is a cross-sectional view of the charging handle, taken along line 23-23 shown in FIG. 22.
Figure 23A:
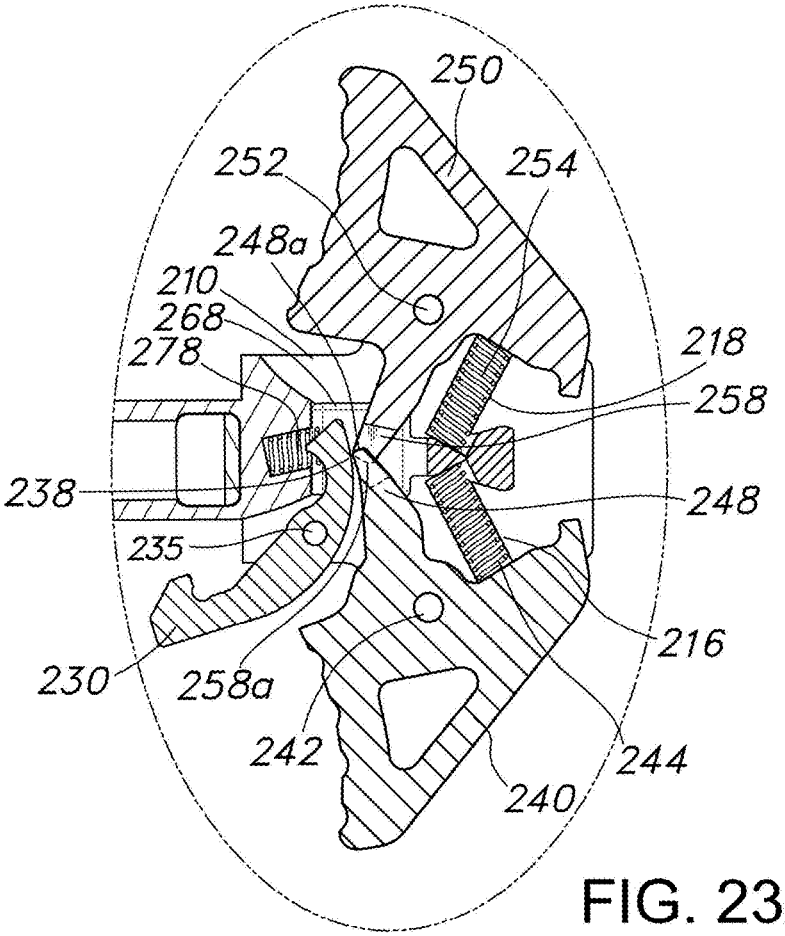
FIG. 23A is an enlarged view of a portion of the charging handle shown in FIG. 23.

Both the first lever 240 and the second lever 250 also include a biasing arm (248, 258). Each biasing arm (248, 258) is an elongate shaft with a radiused tip. As shown in FIG. 23A, the end portions (248*a*, 258*a*) of the biasing arms (248, 258) nest together, allowing the radiused tips of both biasing arms (248, 258) to simultaneously contact the cam surface 238 of the latch 230. In this context, "nest" refers to an overlapping arrangement of the end portions (248*a*, 258*a*) of the biasing arms (248, 258) (see, e.g., FIG. 23A).

Figure 18:
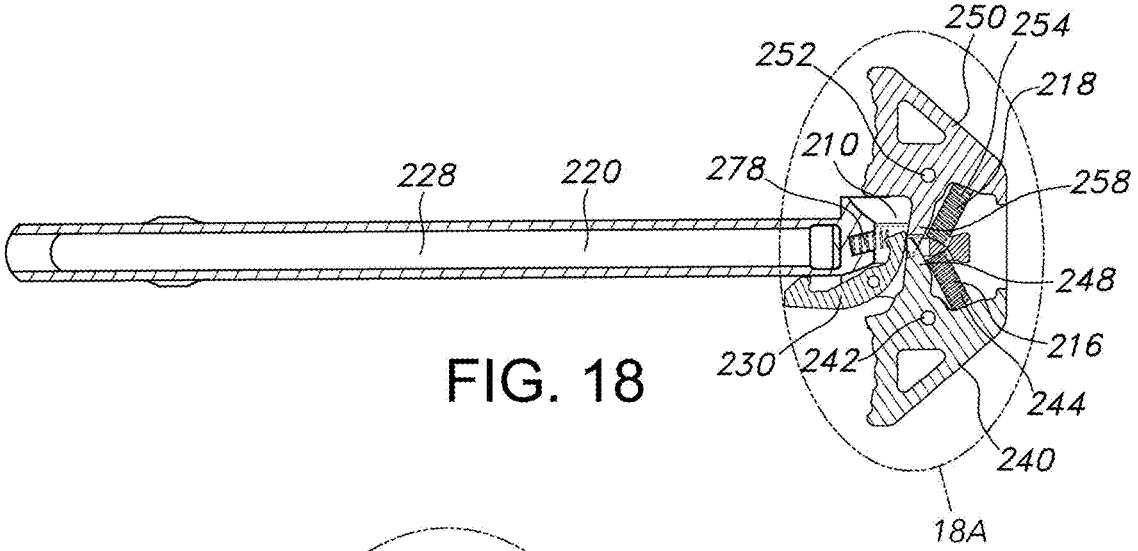
FIG. 18 is a cross-sectional view of the charging handle, taken along line 18-18 shown in FIG. 17.
Figure 18A:
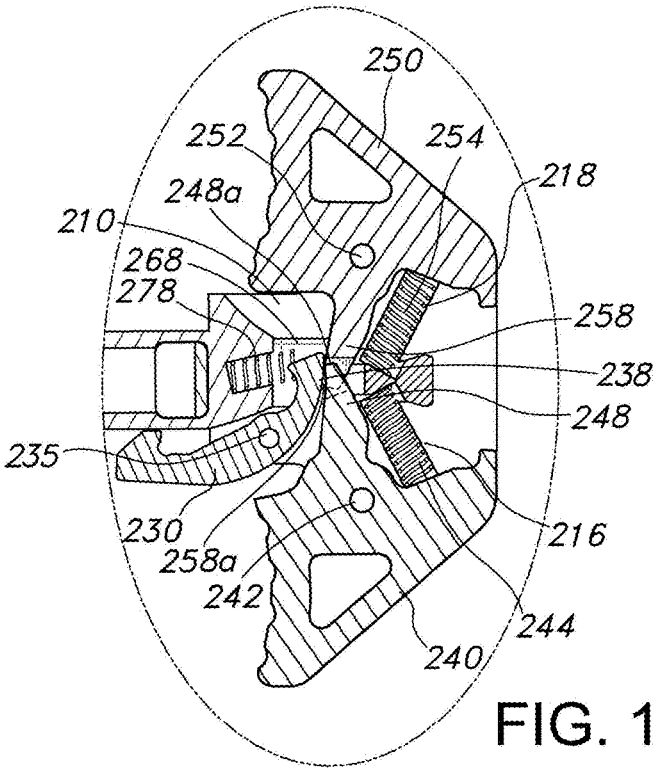
FIG. 18A is an enlarged view of a portion of the charging handle shown in FIG. 18.
Figure 19:
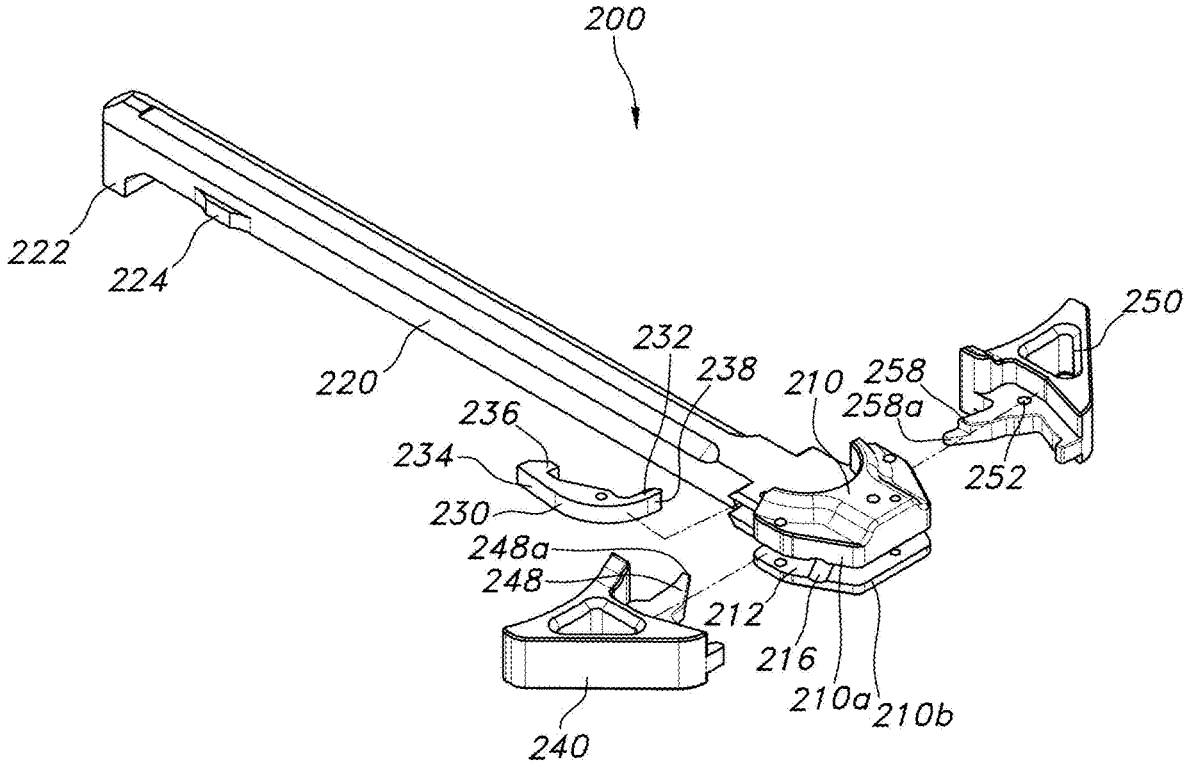
FIG. 19 is an exploded perspective view of the charging handle shown in FIG. 13.
Figure 20:
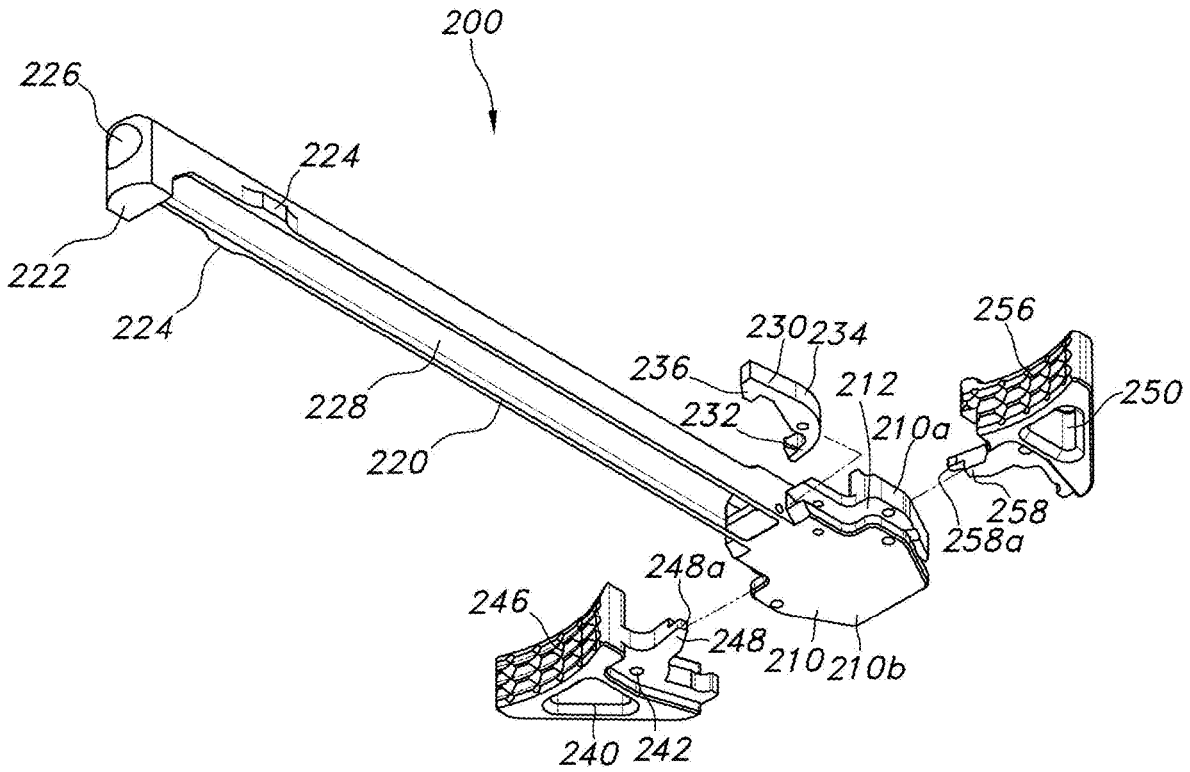
FIG. 20 is another exploded perspective view of the charging handle shown in FIG. 13.
Figure 21:
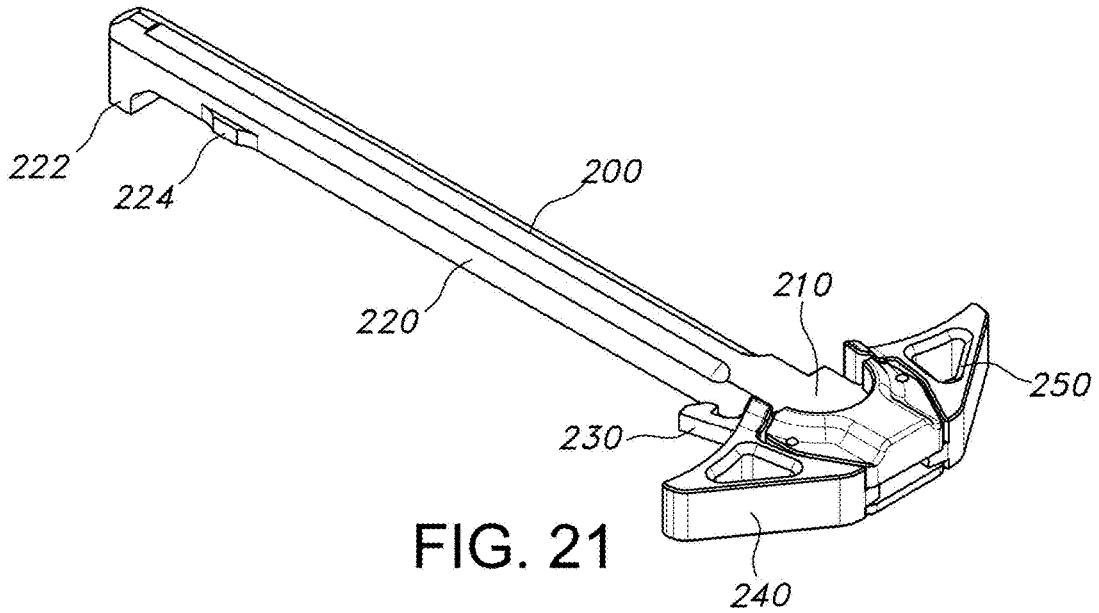
FIG. 21 is yet another perspective view of the charging handle shown in FIG. 13.
Figure 26:
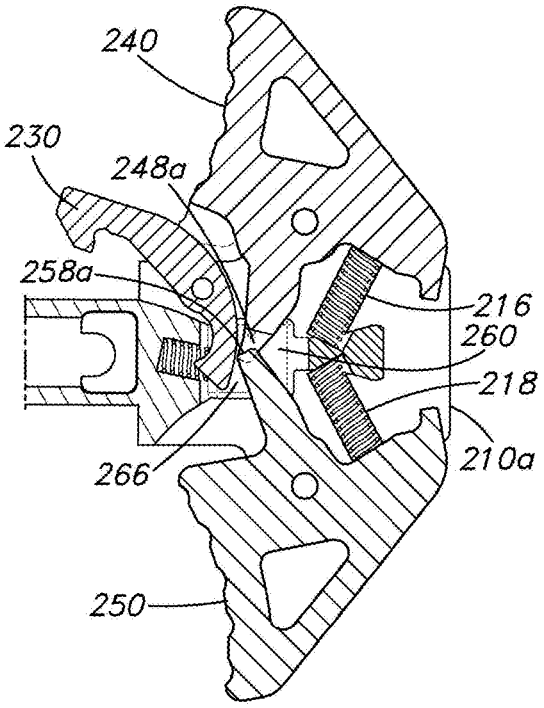
FIG. 26 is an additional cross-sectional view of the charging handle shown in FIG. 25, wherein the latch has been pivoted to the released position by both levers.
Figure 27:
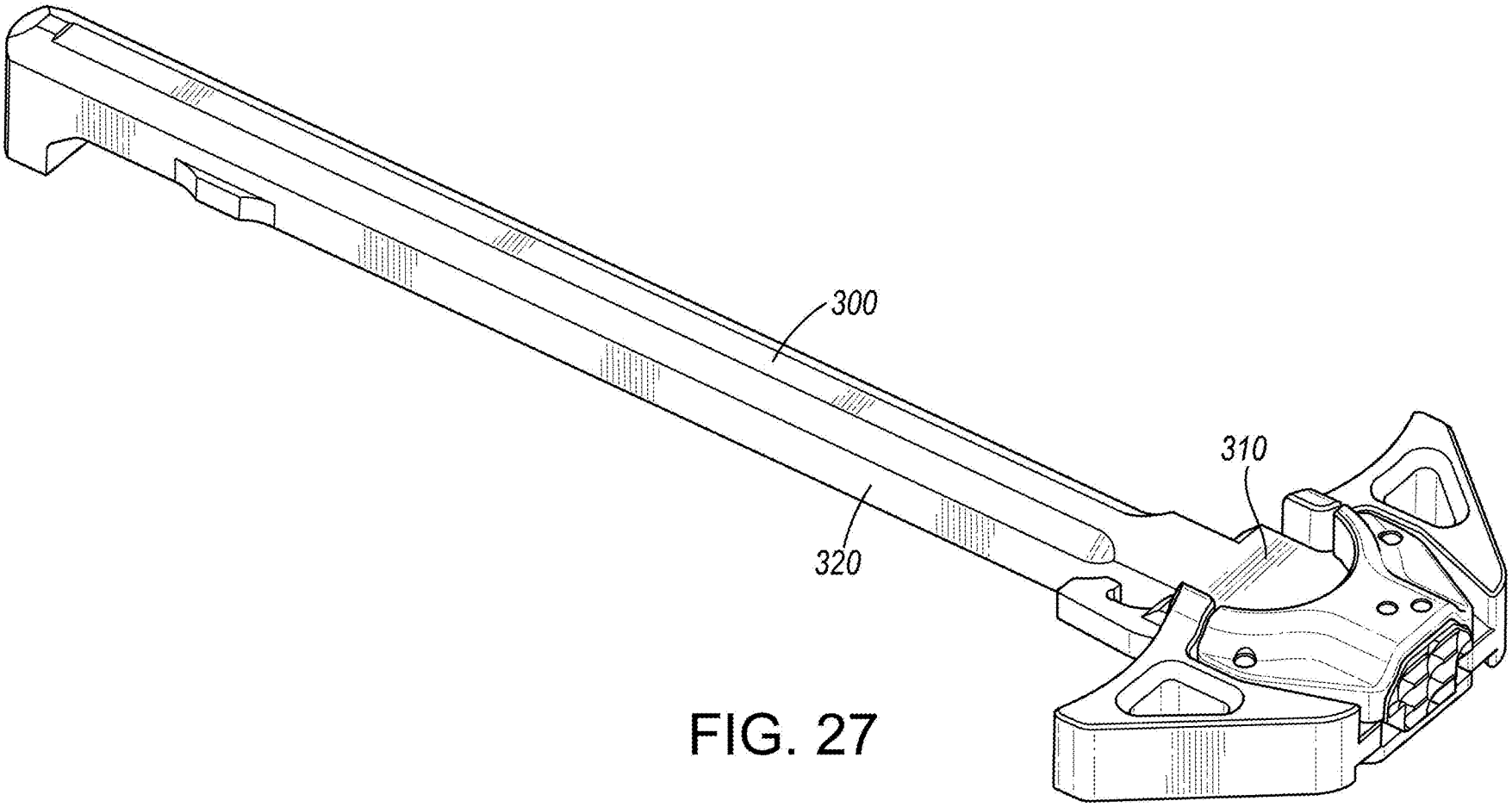
FIG. 27 is a perspective view of yet another charging handle according to the principles of the present disclosure.

As shown in FIGS. 18A and 26, the clearance pocket 260 within the receiving area 212 of the body 210 comprises two recesses (266, 268) positioned opposite each other. One recess 266 is located in the upper portion 210*a*, and the other recess 268 is located in the lower portion 210*b* of the body 210. The end portions (248*a*, 258*a*) of the biasing arms (248, 258) are positioned within the clearance pocket 260, between the two recesses (266, 268), which are configured to accommodate the travel paths of the end portions (248*a*, 258*a*) during operation of the associated levers (240, 250). In particular, the recesses (266, 268) provide clearance for the end portions (248*a*, 258*a*) as they pivot, preventing the biasing arms (248, 258) from catching. Both recesses (266, 268) are substantially rectangular, but may alternatively have other suitable shapes configured to encompass the travel paths of the end portions (248*a*, 258*a*).

While it is possible for the levers (240, 250) to function without the clearance pocket 260, incorporating the clearance pocket 260 into the receiving area 212 of the body 210 enhances reliability by ensuring sufficient clearance for the end portions (248*a*, 258*a*) of the levers (240, 250) as they pivot. Additionally, although the clearance pocket 260 is not strictly required, it simplifies manufacturing by accommodating wider machining tolerances and reducing the need for highly precise alignment.

Operation and Use

When the charging handle 200 is assembled, the biasing arm 248 of the first lever 240 and the biasing arm 258 of the second lever 250 are positioned within the receiving area 212 of the body 210. The first lever 240 and the second lever 250 are configured such that both biasing arms (248, 258) are in contact with the cam surface 238 on the latch arm 232.

Figure 22:
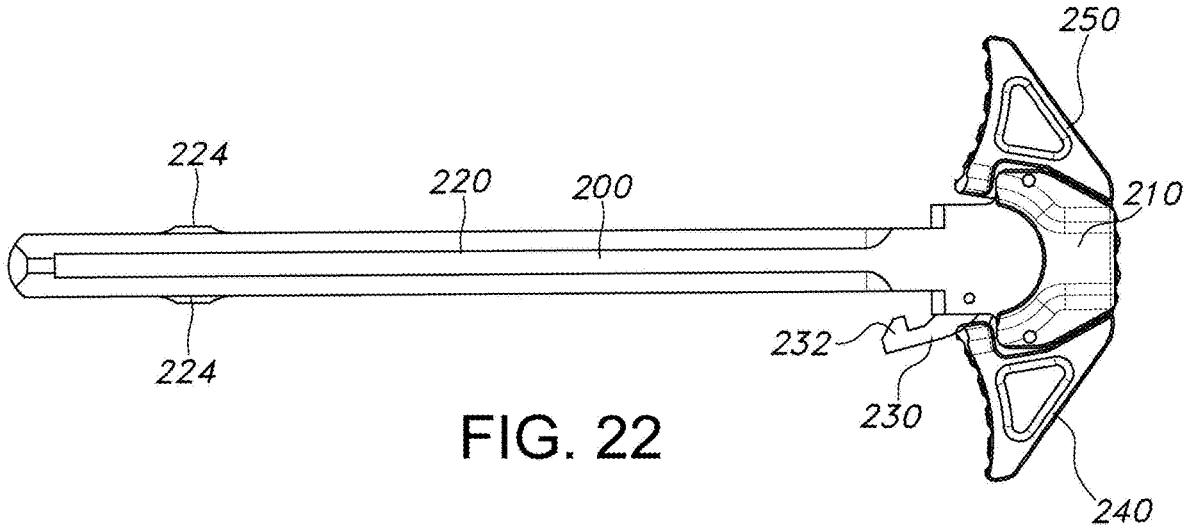
FIG. 22 is another top plan view of the charging handle shown in FIG. 13.

Applying a sufficient rearward force to the first lever 240, the second lever 250, or both causes the respective biasing arm(s) (248, 258) to press against the cam surface 238 of the latch arm 232, thereby urging the latch 230 into the released position (see, e.g., FIG. 22).

When the latch 230 is biased into the released position, the latch biasing mechanism, a compression spring 278 housed within a cavity in the body 210, is compressed. This compression generates a restoring force that urges the latch 230 to return to its relaxed position once the force applied by the user to the first lever 240 and/or the second lever 250 is sufficiently reduced.

FIGS. 27-31 illustrate yet another example charging handle 300 according to the principles of the present disclosure. The charging handle 300 is similar to the charging handles (100, 200) disclosed above, particularly the charging handle 100 shown in FIGS. 1-11. However, the charging handle 300 includes a gas blowback mitigation feature 380. This gas blowback mitigation feature 380 is configured to reduce the volume of combustion gases exiting beneath the charging handle 300 when firing the host firearm, particularly when a sound suppressor is attached.

Figure 29:
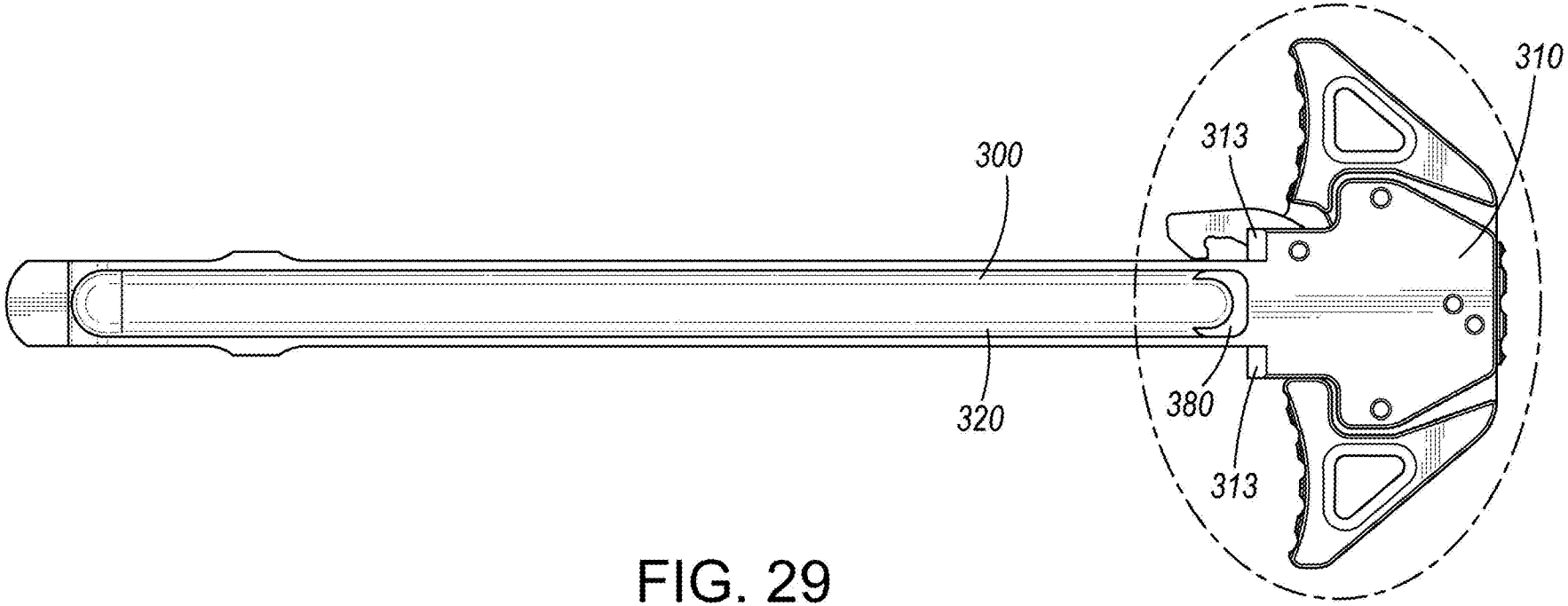
FIG. 29 is a bottom plan view of the charging handle shown in FIG. 27.
Figure 30:
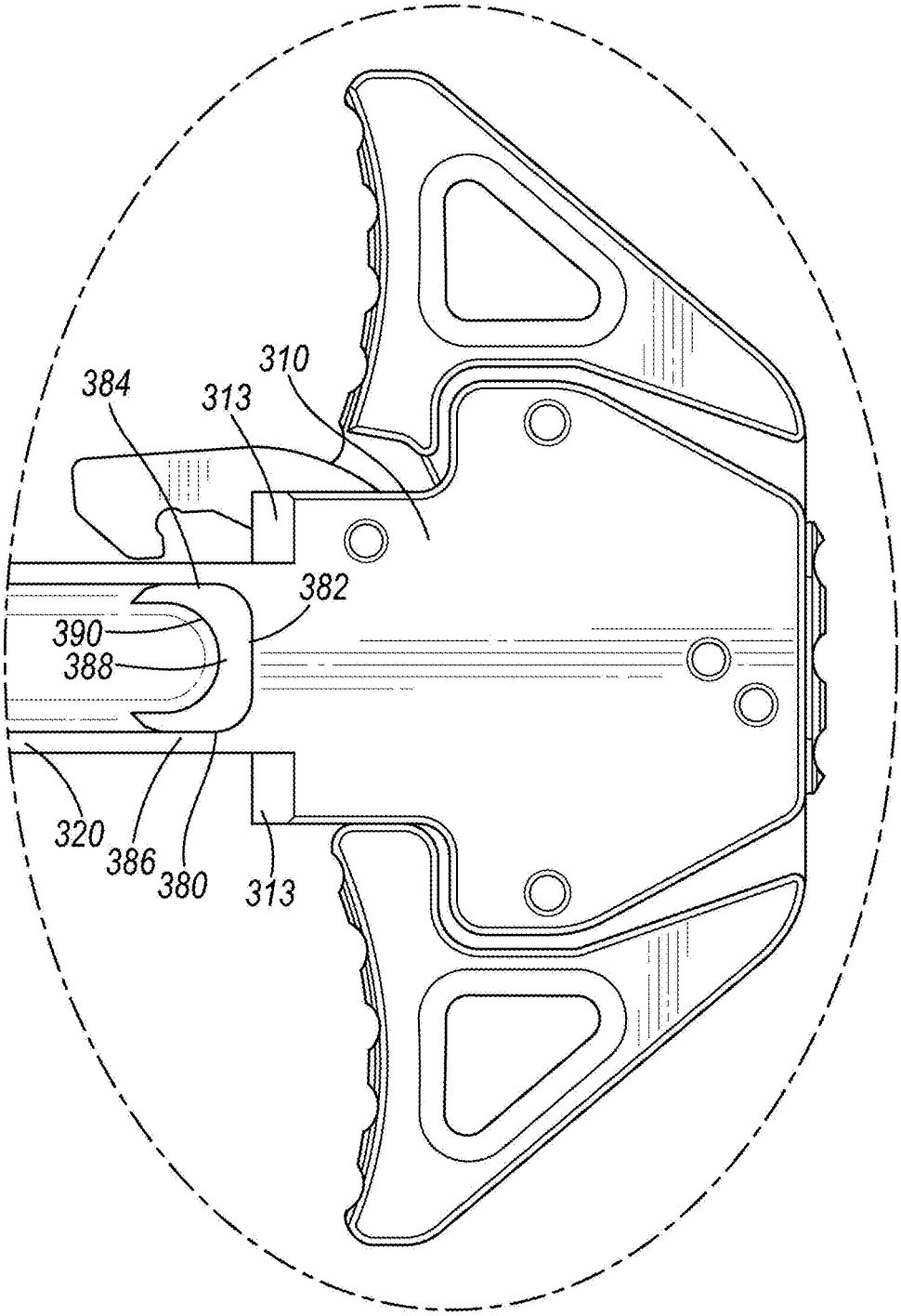
FIG. 30 is an enlarged view of a portion of the charging handle shown in FIG. 29.
Figure 31:
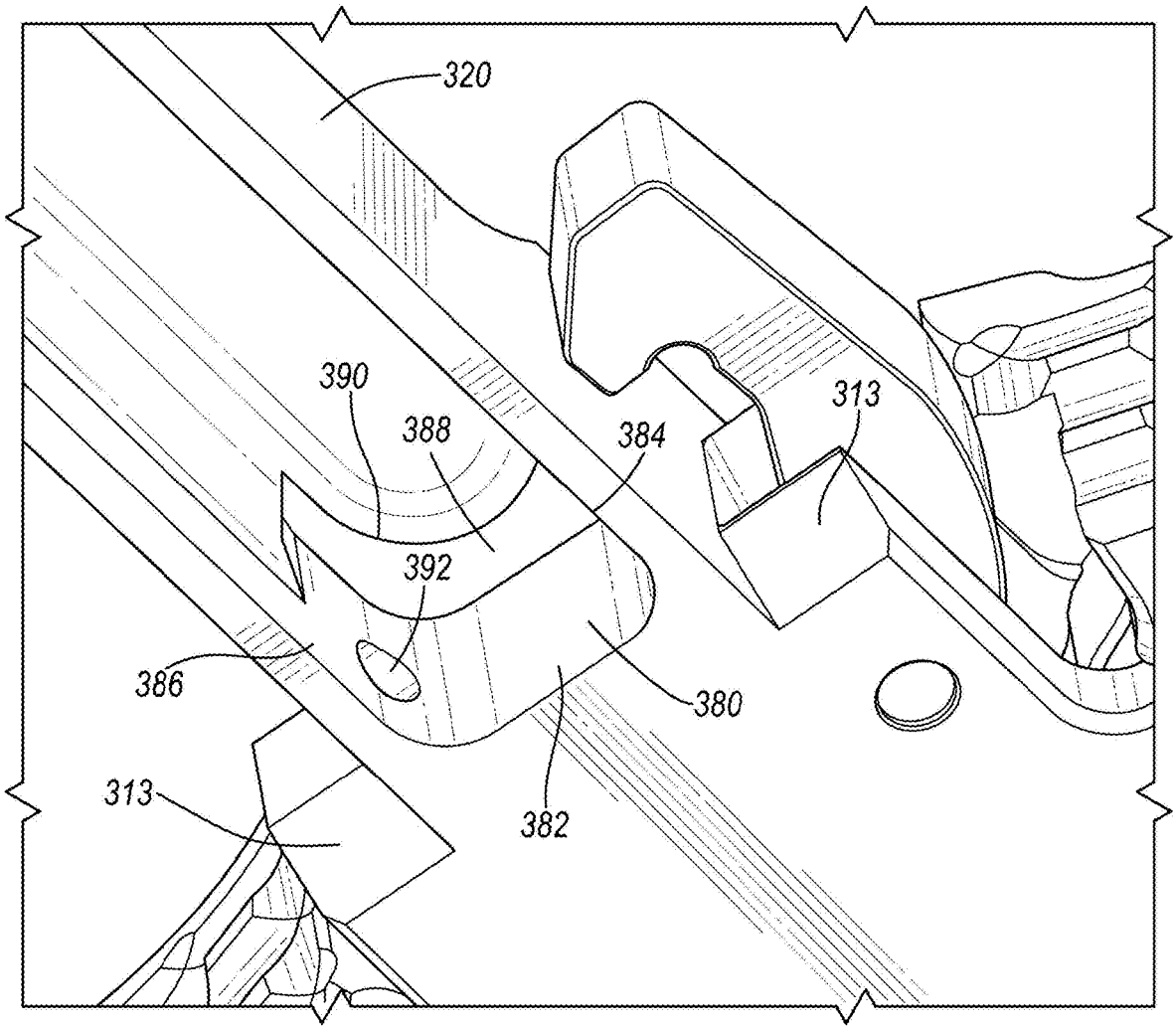
FIG. 31 is a perspective view of the gas blowback mitigation feature of the charging handle shown in FIG. 30.

As shown best in FIGS. 29-31, the gas blowback mitigation feature 380 is a cutout formed in the underside of the central shaft 320. The cutout 380 provides clearance for the gas key of the host firearm's bolt carrier, allowing it to properly cycle. The cutout 380 defines a generally prismatic cavity bounded by three sidewalls (382, 384, 386) and a bottom 388. In some implementations, the sidewalls (382, 384, 386) are substantially orthogonal to the bottom 388 of the cutout 380. The use of one or more orthogonal sidewalls (382, 384, 386) allows the cutout 380 to act as a baffle, thereby slowing the exit of combustion gases from underneath the charging handle 300. However, in other implementations, one or more of the sidewalls (382, 384, 386) may be angled, tapered, or otherwise non-orthogonal relative to the bottom 388. The rear sidewall 382 is perpendicular to the longitudinal axis of the central shaft 320, with one lateral sidewall (384, 386) extending from each end. Fillets, i.e., rounded transitions, are provided at the intersections between the rear sidewall 382 and each of the lateral sidewalls (384, 386). The rear sidewall 382 may be aligned with the forward ends of two chamfered edges 313, which are positioned on opposite sides of the central shaft 320 at the front edge of the body 310. This position of the rear sidewall 382 provides clearance for the gas key during the movement cycle of the bolt carrier and may also help to minimize the volume of gas escaping underneath the charging handle 300. The bottom 388 of the cutout 380 is defined at one end by a semicircular edge 390, which also forms a top edge of a depending sidewall.

Figure 28:
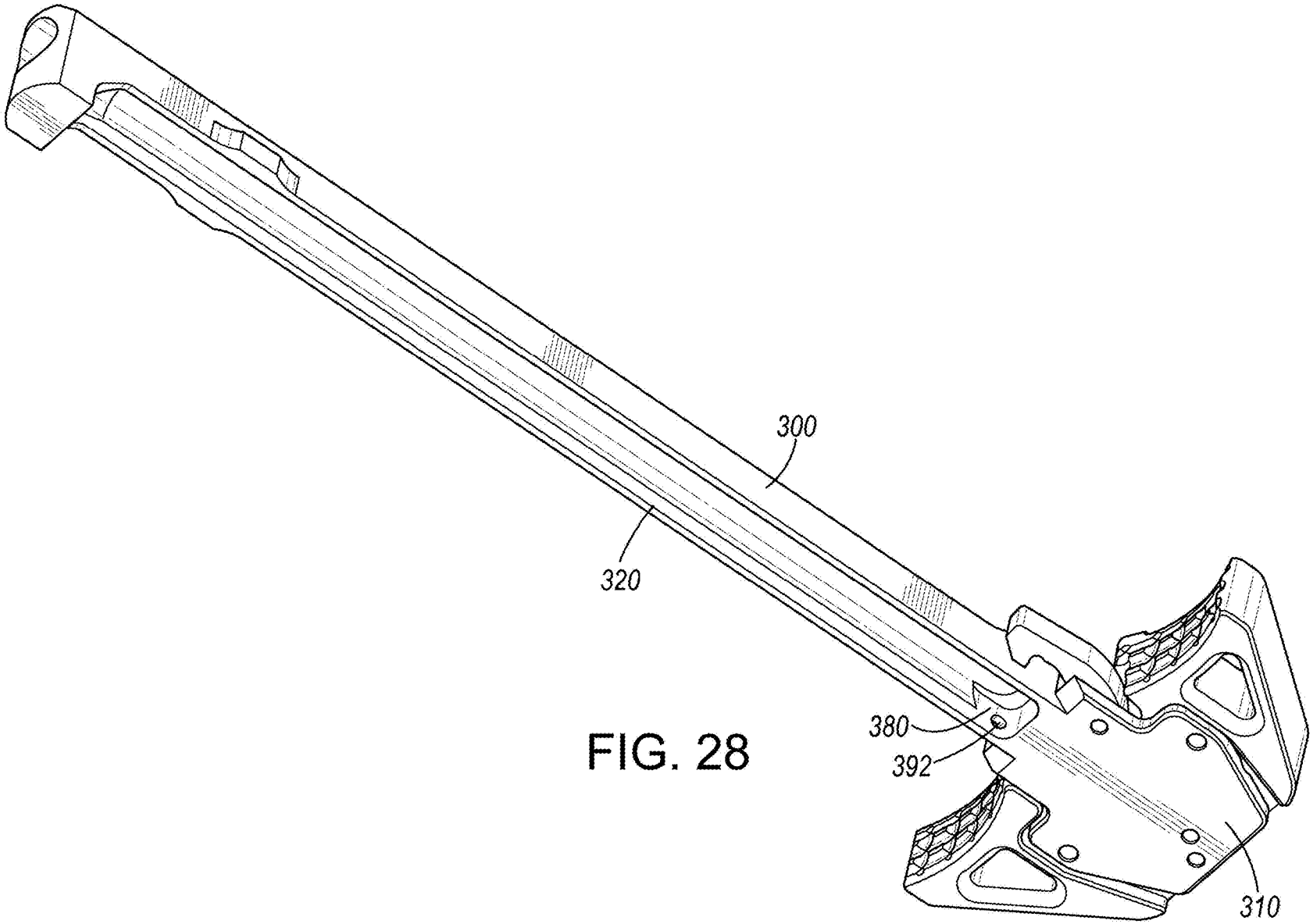
FIG. 28 is another perspective view of the charging handle shown in FIG. 27.

As shown in FIGS. 28 and 31, in some implementations, the cutout 380 includes a vent opening 392 extending through one of the lateral sidewalls (e.g., lateral sidewall 386). The vent opening 392 is in fluid communication with the atmosphere. In some implementations, the cutout 380 does not include a vent opening 392.

In some implementations, an insert configured to fit within the cutout 380 may be provided. The insert may substantially fill the cutout 380. In some implementations, the insert may be held in position by a fastener, such as a pin, extending through the vent opening 392.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A charging handle for a firearm, the charging handle comprising:

a body;

a central shaft extending forwardly from the body, the central shaft being configured to engage a bolt carrier of the firearm; and a cutout formed in an underside of the central shaft, the cutout defining a cavity bounded by a rear sidewall, two lateral sidewalls, and a bottom.

2. The charging handle of claim 1, wherein the two lateral sidewalls extend from opposite ends of the rear sidewall.

3. The charging handle of claim 2, wherein fillets are provided at intersections between the rear sidewall and each of the two lateral sidewalls.

4. The charging handle of claim 1, wherein the rear sidewall is aligned with forward ends of chamfered edges on opposite sides of the central shaft.

5. The charging handle of claim 1, wherein the bottom of the cutout is defined at one end by a semicircular edge.

6. The charging handle of claim 5, wherein the semicircular edge forms a top edge of a depending sidewall.

7. The charging handle of claim 1, wherein the cavity includes a vent opening extending through one of the two lateral sidewalls.

8. The charging handle of claim 1, wherein the rear sidewall is substantially orthogonal to the bottom of the cutout.

9. The charging handle of claim 8, wherein the two lateral sidewalls are substantially orthogonal to the bottom of the cutout.

10. A charging handle for a firearm, the charging handle comprising:

a body;

a central shaft extending forwardly from the body, the central shaft being configured to engage a bolt carrier of the firearm; and a cutout formed in an underside of the central shaft, the cutout defining a cavity bounded by a rear sidewall, a first lateral sidewall, a second lateral sidewall, and a bottom;

wherein the cavity has a generally prismatic shape.

11. The charging handle of claim 10, wherein the first lateral sidewall extends from a first end of the rear sidewall, and the second lateral sidewall extends from a second end of the rear sidewall.

12. The charging handle of claim 11, wherein fillets are provided at intersections between the rear sidewall and each of the first and second lateral sidewalls.

13. The charging handle of claim 10, wherein the rear sidewall is aligned with forward ends of chamfered edges on opposite sides of the central shaft.

14. The charging handle of claim 10, wherein the bottom of the cutout is defined at one end by a semicircular edge.

15. The charging handle of claim 14, wherein the semicircular edge forms a top edge of a depending sidewall.

16. The charging handle of claim 10, wherein the cavity includes a vent opening extending through the first lateral sidewall, the vent opening providing fluid communication between the cavity and an exterior environment.

17. The charging handle of claim 10, wherein the rear sidewall is substantially orthogonal to the bottom of the cutout.

18. The charging handle of claim 17, wherein the first lateral sidewall and the second lateral sidewall are substantially orthogonal to the bottom of the cutout.

* * * * *